US010261440B2

(12) United States Patent
Erickson et al.

(10) Patent No.: US 10,261,440 B2
(45) Date of Patent: Apr. 16, 2019

(54) SPINDLE DISPENSING TONER CARTRIDGE

(71) Applicant: Katun Corporation, Minneapolis, MN (US)

(72) Inventors: Terry Dean Erickson, St. Paul, MN (US); Joseph Allen Amberg, Chanhassen, MN (US); Ryan Bayliss, Bloomington, MN (US)

(73) Assignee: Katun Corporation, Minneapolis, MN (US)

( * ) Notice: Subject to any disclaimer, the term of this patent is extended or adjusted under 35 U.S.C. 154(b) by 0 days.

(21) Appl. No.: 15/531,704

(22) PCT Filed: Mar. 16, 2016

(86) PCT No.: PCT/US2016/022674
§ 371 (c)(1),
(2) Date: May 30, 2017

(87) PCT Pub. No.: WO2017/160287
PCT Pub. Date: Sep. 21, 2017

(65) Prior Publication Data

US 2018/0081298 A1 Mar. 22, 2018

(51) Int. Cl.
*G03G 15/08* (2006.01)

(52) U.S. Cl.
CPC ..... *G03G 15/0872* (2013.01); *G03G 15/0889* (2013.01); *G03G 2215/0678* (2013.01)

(58) Field of Classification Search
CPC ..... G03G 15/0832; G03G 15/0836; G03G 15/0837; G03G 15/0839; G03G 15/0865; G03G 15/0867; G03G 15/087; G03G 15/0872; G03G 15/0877; G03G 15/0887; G03G 15/0889; G03G 15/0891; G03G 2215/0678
See application file for complete search history.

(56) References Cited

U.S. PATENT DOCUMENTS

| | | | |
|---|---|---|---|
| 5,918,095 | A | 6/1999 | Huang |
| 7,398,038 | B2 | 7/2008 | Tsuda et al. |
| 7,702,262 | B2 | 4/2010 | Taguchi et al. |
| 7,706,699 | B2 | 4/2010 | Taguchi et al. |
| 7,720,416 | B2 | 5/2010 | Taguchi et al. |

(Continued)

OTHER PUBLICATIONS

"International Application Serial No. PCT/US2016/022674, International Search Report dated May 26, 2016", 2 pgs.

(Continued)

*Primary Examiner* — Hoang Ngo
(74) *Attorney, Agent, or Firm* — Schwegman Lundberg & Woessner, P.A.

(57) ABSTRACT

A cartridge for use with an image forming apparatus. The cartridge includes a container configured for storing a volume of particulate image forming material and a dispensing port in communication with the container. The dispensing port includes a perimeter lip extending around a delivery passage. A dispensing spindle is rotatable relative to at least the dispensing port. The dispensing spindle includes a spindle core a plurality of arms extending from the spindle core. Each of the arms includes a sweeping face configured to sweep across the perimeter lip to convey a quantity of the particulate image forming material to the dispensing port.

30 Claims, 6 Drawing Sheets

(56) References Cited

U.S. PATENT DOCUMENTS

| | | | | |
|---|---|---|---|---|
| 7,720,417 | B2 | 5/2010 | Taguchi et al. | |
| 7,747,202 | B2 | 6/2010 | Taguchi et al. | |
| 7,822,371 | B2 | 10/2010 | Taguchi et al. | |
| 7,835,675 | B2 | 11/2010 | Taguchi et al. | |
| 7,840,167 | B2 | 11/2010 | Taguchi et al. | |
| 7,853,183 | B2 | 12/2010 | Taguchi et al. | |
| 7,853,184 | B2 | 12/2010 | Taguchi et al. | |
| 8,025,796 | B2 | 9/2011 | Janssen et al. | |
| 8,050,597 | B2 | 11/2011 | Yoshizawa et al. | |
| 8,290,378 | B2 | 10/2012 | Ohyama et al. | |
| 8,311,447 | B2 | 11/2012 | Mitsuishi et al. | |
| 8,532,542 | B2 | 9/2013 | Mitsuishi et al. | |
| 8,923,734 | B2 * | 12/2014 | Abler ..... | G03G 15/08 399/262 |
| 2005/0169672 | A1 | 8/2005 | Ban et al. | |
| 2007/0172252 | A1 | 7/2007 | Koyama et al. | |
| 2012/0183333 | A1 | 7/2012 | Ohgoshi et al. | |
| 2013/0322930 | A1 | 12/2013 | Chino | |
| 2014/0079438 | A1 | 3/2014 | Abler et al. | |
| 2014/0079440 | A1 | 3/2014 | Abler et al. | |

OTHER PUBLICATIONS

"International Application Serial No. PCT/US2016/022674, Written Opinion dated May 26, 2016", 5 pgs.
"International Application Serial No. PCT/US2016/022674, International Preliminary Report on Patentability dated Feb. 12, 2018", 4 pgs.
"European Application Serial No. 16894746.3, Extended European Search Report dated Feb. 22, 2019", 8 pgs.

* cited by examiner

SPINDLE DISPENSING TONER CARTRIDGE

PRIORITY APPLICATION

This application is a U.S. national stage application filed under 35 U.S.C. § 371 from International Application Ser. No. PCT/US2016/022674, filed on Mar. 16, 2016, which is incorporated herein by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Katun Corporation; Bloomington, Minn. All Rights Reserved.

TECHNICAL FIELD

This document pertains generally, but not by way of limitation, to containers for particulate material including toner or developer for a printer or photocopier.

BACKGROUND

Image forming apparatuses use one or more consumable materials (e.g., one or more of toner or developer). Cartridges that contain the consumable material, or particulate material, are installed in image forming apparatuses and provide the consumable material to the image forming apparatus through a delivery orifice. In some examples cartridges feed particulate matter by a mechanical feature, such as an auger. The auger is suspended centrally or along a lower region of the cartridge. Rotation of the auger moves the particulate material toward the delivery orifice. The particulate material is dispensed from the delivery orifice to a hopper for use by the image forming apparatus.

In other examples, some cartridges use a pressure differential created between the interior and exterior of the cartridge to deliver the particulate material to the image forming apparatus. For instance, the environment within the cartridge is at least partially sealed and a movable feature such as a diaphragm is actuated to increase pressure within the cartridge. A delivery orifice is provided on the cartridge. The delivery orifice is selectively opened while the interior of the cartridge is at a higher pressure. The pressure differential between the interior and the exterior of the cartridge forces a quantity of particulate material out of the delivery orifice.

OVERVIEW

The present inventors have recognized, among other things, that a problem to be solved can include minimizing inconsistencies in the dispensing rate from image forming material cartridges. In at least one example, a cartridge includes a hermetically sealed environment and a pressure differential generating feature, such as a deflectable diaphragm. The diaphragm is selectively operated to increase and decrease pressure within the cartridge. The variation in pressure pushes image forming material through an outlet (e.g., according to an increase in pressure caused by depression of the diaphragm). In some examples, it is difficult to achieve a consistent flow rate of image forming material because variations in diaphragm deflection cause variances in the pressure differentials. Further, increasing volume within the cartridge as image forming material is dispensed also varies the pressure differential over time. Further still, blockage or caking at the outlet resists clearing when caused by a pressure differential (in contrast to mechanical contact).

The present subject matter can help provide a solution to this problem, such as by providing a rotatable dispensing spindle having a plurality of arms (e.g., blades, bristles, sweeps, fingers or the like). The spindle arms sweeps image forming material across the dispensing port to convey a quantity of the image forming material to (and through) the dispensing port. The spindle arms have a specified shape, size and the like, and accordingly the mechanical engagement along the specified shape of the dispensing port moves a consistent quantity of the image forming material through the dispensing port. Difficult to predict and control features such as diaphragms and pressure differentials generated by diaphragms are thereby avoided. Instead, the mechanical engagement between the spindle and the dispensing port provides a consistent and reliable dispensing rate of image forming material over the lifetime of use for the cartridge.

The present inventors have further recognized, among other things, that another problem to be solved can include minimizing enclosing and sealing image forming material cartridges with hermetic (e.g., air tight or near air tight) seals to facilitate the use of a pressure differential generating mechanism to dispense image forming materials. In some examples, as described above, pressure differentials are generated and used in image forming material cartridges to cause the dispensing of image forming material. Seams in the cartridges are sealed to prevent the ready ingress and egress of air except through the specified dispensing port. The passage of air at the dispensing port is used to discharge the image forming material. In some of these examples, hermetic seals are provided at each of the seams to prevent the ingress and egress of air. In contrast to porous gaskets that capture image forming material (e.g., toner) but permit some passage of air, hermetic seals can be expensive and labor intensive to apply.

The present subject matter can help provide a solution to this problem, such as by providing a container that is closed and uses a spindle having arms (e.g., blades, bristles, sweeps, fingers or the like) that mechanically engage image forming material and move it through a dispensing port. Because of the mechanical dispensing provided by the spindle the container is closed without hermetic seals. Instead, gaskets, porous membranes (that allow gas ingress and egress while blocking particulate passage) and the like are used. Further, the use of porous seals, membranes and the like facilitates the equalization of pressures on the interior and exterior of the container and thereby minimizes (e.g., prevents or decreases) the unpredictable dispensing of image forming material because of pressure differentials therebetween. Accordingly, spikes and dips in the dispensing rate from the spindle at the dispensing port are minimized.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
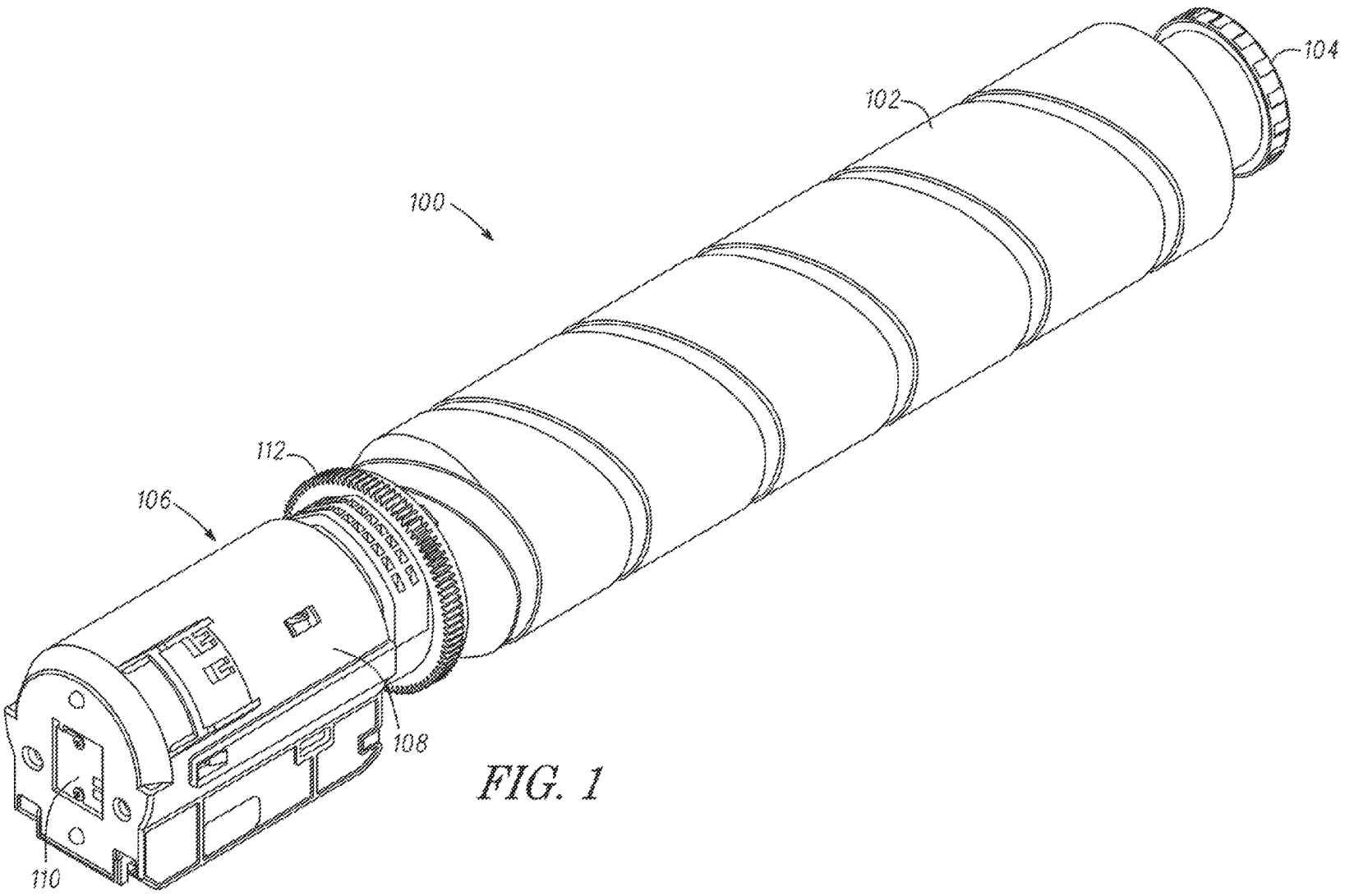
FIG. 1 is a perspective view of one example of an image forming material cartridge.

FIG. 1 shows one example of a cartridge 100 (e.g., an image-forming material cartridge) configured for reception within and use with an image-forming apparatus, for instance a photocopier, printer or the like. In the example shown in FIG. 1, the cartridge 100 includes a container 102 and a cartridge cap 106 coupled with the container 102. As further shown in FIG. 1, the container 102 is, in one example, rotatable relative to the cartridge cap 106. In another example, the container 102 and the cartridge cap 106 are a unitary or fixed assembly with the container 102 fixed with the cartridge cap 106 in such a manner that the container 102 is static relative to the cartridge cap 106.

As further shown in FIG. 1, the container 102, in one example, includes a fill cap 104. The fill cap 104 is selectively removed to allow for filling of the container 102, for instance with an image forming material including one or more of developer, toner or the like. The fill cap 104 is replaced When filling of the container 102 is completed.

Referring to the cartridge cap 106 shown in FIG. 1, the cartridge cap includes, in one example, a shell 108 covering or extending around a plurality of components provided within the cartridge cap 106. As further shown in FIG. 1 the cartridge 100 optionally includes a data storage medium 110. In the example shown in FIG. 1, the data storage medium 110 is coupled with the cartridge cap 106, for instance along the shell 108 (in a recess, adhered, fastened or the like). The data storage medium 110 includes one or more of an RFID chip, electrical contacts and memory thereon or the like configured to interact with corresponding components (e.g., one or more of reading or writing components) in an image-forming apparatus.

As previously described herein, in one example, the cartridge 100 including, for instance, the container 102 is rotatable relative to one or more other components of the cartridge 100. In this example, the container 102 is rotatable relative to the cartridge cap 106. A drive gear 112 is, in one example, coupled with the container 102 and configured to receive a driving force, for instance from a corresponding input gear provided with the image-forming apparatus. Rotation of the input gear correspondingly rotates the drive gear 112 and that rotation is transmitted to the container 102 to rotate the container 102 relative to the cartridge cap 106. As shown in FIG. 1 and described further herein, in one example, the container 102 includes a transport mechanism (e.g., helical ridges, angled ridges, corresponding recesses, an auger, rotating blades, arms, scoops, spiral wires or the like) configured to move image-forming material within the container 102 toward the cartridge cap 106 and a dispensing port associated with the cartridge cap 106. As shown in FIG. 1 the transport mechanism is static relative to the container 102. In another example, for instance where the container 102 and the cartridge cap 106 (e.g., including the dispensing port) are coupled together in a static manner, the container 102 includes an a transport mechanism (e.g., rotating auger, blades, arms, scoops, spiral wires or the like) or other movement apparatus that moves relative to the container and is configured to move the image forming material within (and relative to) the container 102 toward the dispensing port. That is to say, the container 102 and the cartridge 100 generally include one or more transport mechanism such as augers, blades, scoops, spiral wires or the like that move relative to the container 102 and the cartridge cap 106 to move the image-forming material toward the dispensing port and the cartridge cap 106.

Figure 2A:
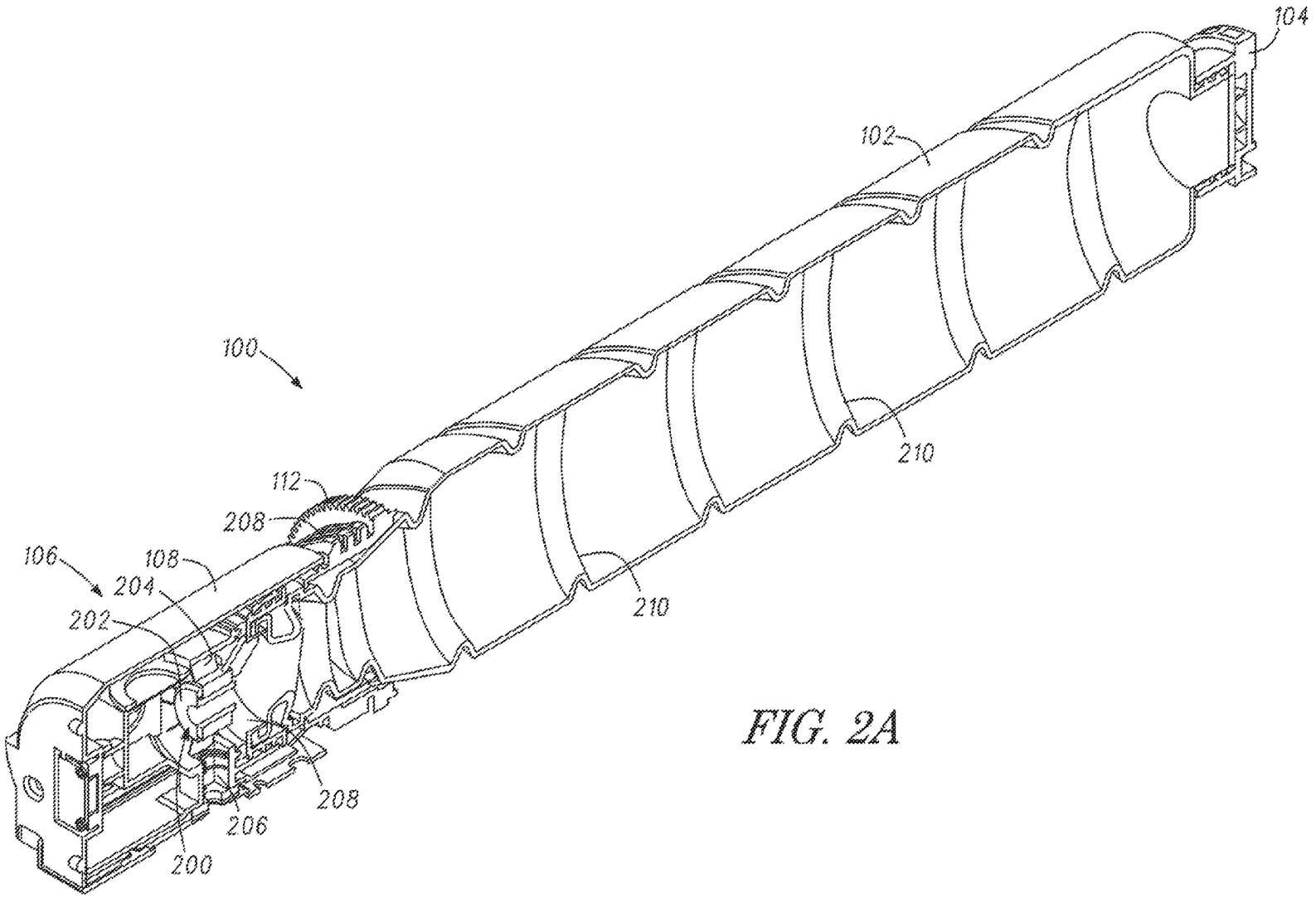
FIG. 2A is a sectional perspective view of the image forming material cartridge of FIG. 1.

FIG. 2A shows a cross-sectional view of the cartridge 100 previously shown in FIG. 1. As previously described, the cartridge 100 includes, in an example, a container 102 coupled with a cartridge cap 106. Optionally, the container 102 rotates relative to the cartridge cap 106, for instance by way of rotation of a drive gear, such as the drive gear 112 shown coupled with the container 102. As also described herein in another example, the container 102 is static relative to the cartridge cap 106 or a dispensing port (e.g., included in a cartridge cap or with the container if a cap is not present). In such an example, an auger or other feature extends through the container 102 and is rotated or moved to accordingly move the image-forming material within the container 102 toward the dispensing port 206.

In the example shown in FIG. 2A, the container 102 is rotatable relative to the cartridge cap 106. As further shown, a transport mechanism 210 is formed in the container 102 between both ends of the container and toward the dispensing port 206 of the cartridge cap 106. The transport mechanism includes a helical ridge, angled ridges or recesses or any of the other options described herein and their equivalents. Rotation of the container 102, for instance by way of the drive gear 112, accordingly moves image forming material within the container 102 toward the dispensing port 206.

FIG. 2A further shows a drive interface 208 including, for instance, the drive gear 112 thereon. As shown, the drive interface 208 provides an interface between the container 102 and the cartridge cap 106. In one example, the drive gear 112 is an integral component of the drive interface 208. In another example, the drive gear 112 is coupled with one or more of the container 102 or the drive interface 208. The drive interface 208 thereby facilitates rotation of the container 102 (and as described herein, in one example, rotation of the spindle 200).

As further shown in FIG. 2A, the cartridge 100 includes a dispensing feature configured to assist with the consistent and reliable dispensing of image forming material at a specified rate. As shown in FIG. 2A, the dispensing mechanism includes a dispensing spindle 200 rotatably coupled within the cartridge 100. As shown, the dispensing spindle 200, in this example, is rotatable relative to the cartridge cap 106. The dispensing spindle 200 includes, in an example, a spindle core 202 and one or more spindle arms 204 extending from the spindle core 202. The spindle arms 204, in one example, are deflectable members configured to move within the cartridge cap 106 and accordingly transport imaging-forming material toward the dispensing port 206 for eventual dispensing through the dispensing port 206, for instance to an image-forming apparatus. The spindle arms 204 include, but are not limited to, one or more of blades, bristles, sweeps, fingers or the like.

As will be described herein, in one example, the spindle arms 204 are integral to the spindle core 202. For instance, the spindle arms 204 are co-molded with the spindle core 202. In another example, the spindle arms 204 are separate members from the spindle core 202. In such an example, the spindle arms 204 are coupled with the spindle core 202 with one or more mechanisms including, but not limited to, adhesives, fasteners, mechanical interfitting such as clamping, interference fits or the like. As will be described herein, the spindle arms 204, in one example, sweep along a spindle barrel (e.g., wipe along the barrel, brush along the barrel, move across the barrel without contacting the barrel inner surface) to thereby move image-forming material toward the dispensing port 206. The spindle arms 204 further sweep across the dispensing port 206 in a consistent manner according to rotation of the spindle 200. The consistent rotation of the spindle arms 204 provide a mechanical feature that reliably delivers a set amount of image forming material (according to the size, shape or the like of the spindle arms 204) to the dispensing port 206 and thereby ensures a corresponding delivery rate to an image-forming apparatus, for instance through the dispensing port 206.

Figure 2B:
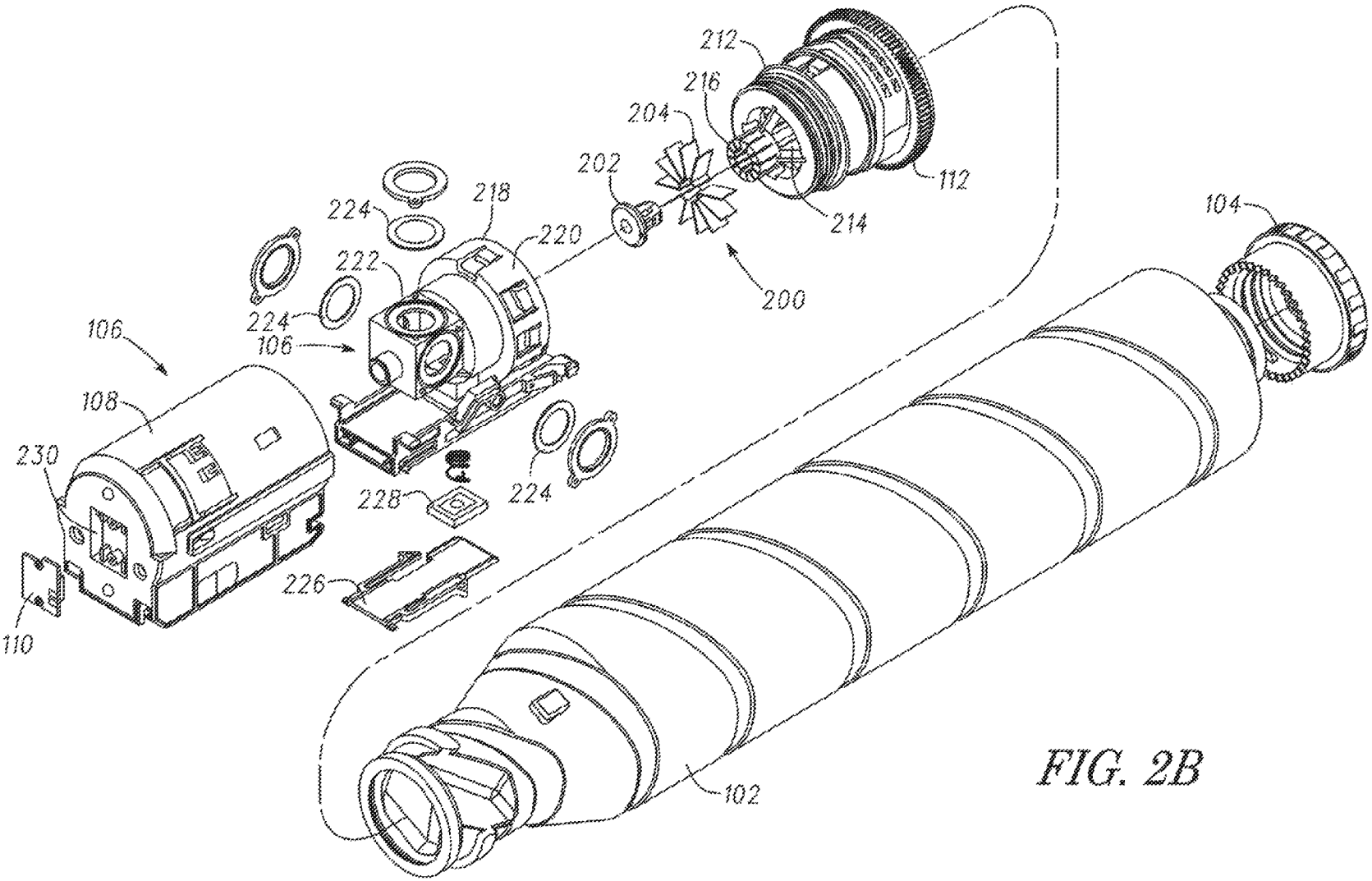
FIG. 2B is an exploded view of the image forming material cartridge of FIG. 1.

FIG. 2B shows the cartridge 100 in an exploded configuration. As shown, the container 102 is separated from the drive interface 212 and the drive interface 212 is interposed between the cartridge cap 106 and the container 102. As previously described the cartridge 100 includes the container 102 rotatable relative to the cartridge cap 106. In one example, the drive interface 212 is coupled with the container 102 and provides the drive gear 112 configured to rotate the container 102 relative to the cartridge cap 106. As shown in FIG. 2B, the drive interface 212 includes one or more material passages 214 configured to pass image-forming material from the container 102, for instance into the spindle housing 218 of the cartridge cap 106 including the dispensing port 206 (see FIG. 2A).

As further shown in FIG. 2B, in one example, the drive interface 212 includes a spindle end 216 sized and shaped for coupling with the spindle 200. Optionally, the spindle end 216, in another example, is incorporated as part of the spindle 200. The spindle end 216 in cooperation with the drive gear 112 of the drive interface 212 transmits rotational motion to the spindle 200, for instance to move the spindle arms 204 relative to the dispensing port 206 to thereby deliver image forming material through the dispensing port 206. As shown in FIG. 2B, in one example, the spindle 200 includes a spindle core 202 and a plurality of spindle arms 204 extending from the spindle 200. In the example shown in FIG. 2B, the spindle arms 204 are coupled with the spindle core 202. In another example, the spindle arms 204 are integral with the spindle core 202 and the spindle 200 is thereby a unitary component. Optionally, and as described herein, the spindle end 216 of the drive interface 212 is coupled with the spindle 200. That is to say, rotation of the drive interface 212, for instance by way of the drive gear 112, is transmitted to the spindle 200 to accordingly rotate the spindle 200 relative to the cartridge cap 106 and the dispensing port 206 (see FIG. 2A) by way of the spindle end 216. In another example, the spindle 200 is rotatable relative to the cartridge 100, for instance by way of one or more other rotatable means including, but not limited to, a drive shaft or other feature extending through the cartridge 100 and configured for coupling to a corresponding rotating feature of the image-forming apparatus. The spindle end 216 is in one example a portion of the drive interface 212. In another example, the spindle 200 includes the spindle end 216 and the drive interface 212 couples with the spindle 200 including the spindle end 216.

FIG. 2B further shows a spindle housing 218 sized and shaped for reception within the shell 108 of the cartridge cap 106. In one example, the cartridge cap 106 includes the shell 108 and a spindle housing 218 separable from the shell 108. In another example, the spindle housing 218 is incorporated with the shell 108 and accordingly the cartridge cap 106 is a unitary component including the features of both the shell 108 and the spindle housing 218.

As further shown in FIG. 2B, the spindle housing 218 includes a spindle barrel 220. The spindle barrel 220 is configured to receive the spindle 200 including, for instance, the spindle core 202 and the spindle arms 204 therein. As will be described herein, the spindle arms 204 are, in one example, configured to sweep along or deflect along the interior of the spindle barrel 220 (e.g., wipe, deflect, brush, move along in close proximity but without touching, or the like) to thereby transport image-forming material within the spindle barrel 220 (received from the container 102 through the optional material passages 214) and move the image-forming material toward the dispensing port 206. The spindle arms 204, in one example, have a consistent size and shape and thereby accordingly move a consistent amount of image-forming material to the dispensing port. The cartridge 100 thereby delivers a predictable and reliable amount of image forming material at a specified dispensing rate according to rotation of the spindle 200.

As further shown in FIG. 2B, in one example, the spindle housing 218 includes one or more vents 222 configured to equalize pressure between the interior of the cartridge 100 and the exterior of the cartridge 100. As previously described herein, in one example, pressure differentials between the exterior and the interior of the cartridge 100 frustrate the consistent and reliable delivery of image-forming material through the dispensing port 206. By providing the vents 222 and optional porous membranes 224 (that allow for the passage of gases such as air but otherwise prevent the ingress of dust or egress of particulate image-forming material) pressure is equalized between the interior and the exterior of the cartridge 100 to thereby facilitate the accurate and reliable delivery from the spindle 200 through the dispensing port 206 without variation caused by pressure differentials within the cartridge 100 relative to the exterior of the cartridge 100. Optionally, the porous membrane 224 includes, but is not limited to, a gas permeable film such as a polytetrafluoroethylene (PTFE) film or the like.

FIG. 2B further shows one or more optional features included with the cartridge 100 including, but not limited to, a shutter 226 moveable relative to the cartridge cap 106 and a shutter gasket 228 coupled with the shutter 226. In one example, the shutter and shutter gasket 226, 228 cooperate to accordingly close a dispensing port such as the port 206 shown, for instance in FIG. 2A. When opening of the cartridge 100 is desired the shutter 226 as well as its gasket 228 are moved relative to the dispensing port 206 to open the dispensing port 206 for the dispensing of image-forming material from the cartridge 100. Optionally, the shutter gasket 228 is coupled with the cartridge cap 106, for instance with a lower surface of the spindle housing 218. With movement of the shutter 226 the shutter gasket 228 remains coupled with the spindle housing 218 and the shutter 226 moves relative to both the shutter gasket 228 (having a passage there through) and the spindle housing 218.

As further shown in FIG. 2B, in one example, the shell 108 includes a memory recess 230 sized and shaped for reception of the data storage medium 110 (previously shown in FIG. 1) therein. The shell 108 provides a shaped tilting that is configured to position the data storage medium 110 adjacent to a corresponding component of an image-forming apparatus such as a photocopier, printer or the like when the cartridge 100 is installed in an image-forming apparatus.

Figure 3:
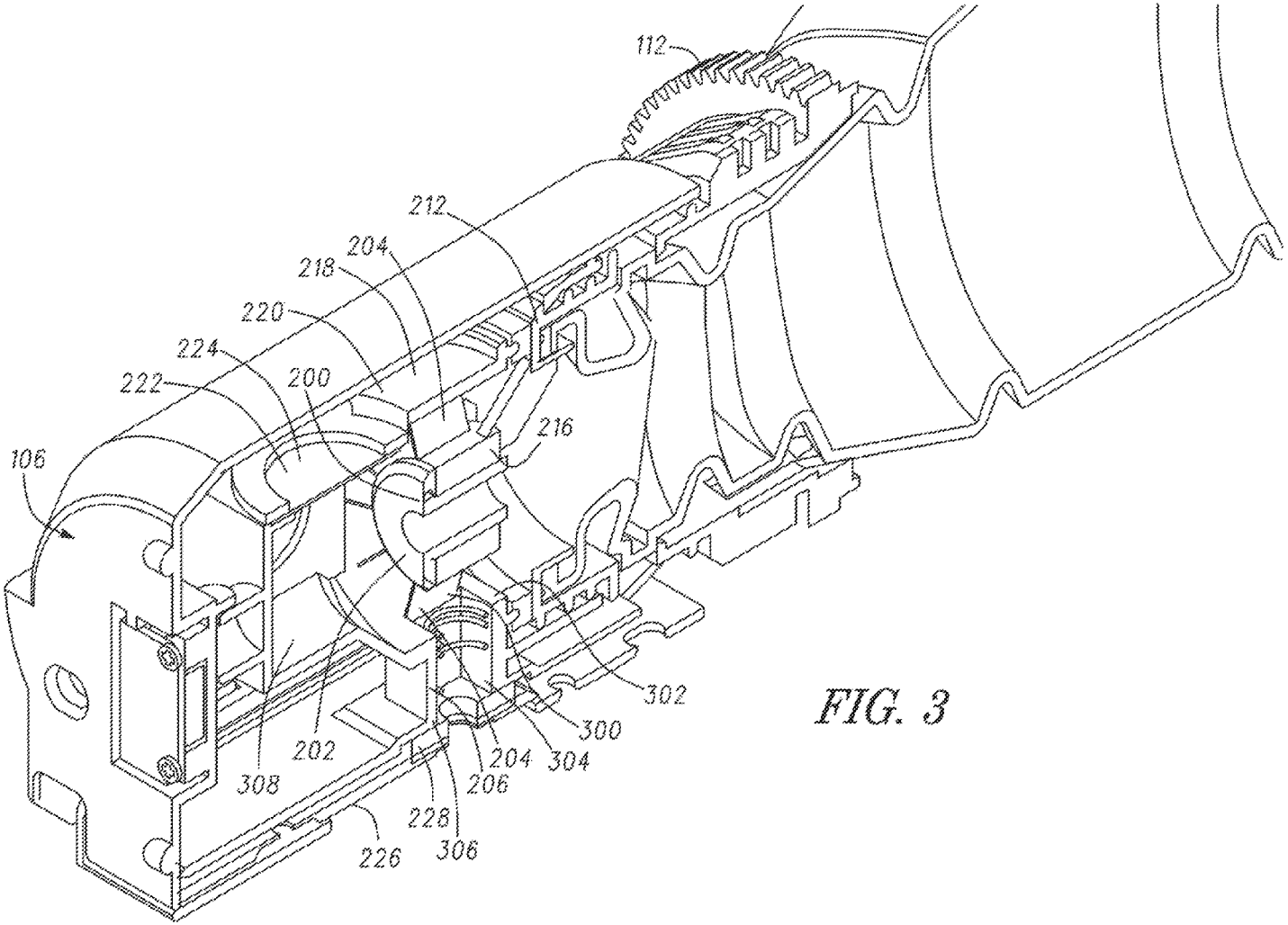
FIG. 3 is a detailed sectional view of a cartridge cap of FIGS. 2A, B.

FIG. 3 shows a detailed cross-section of a portion of the cartridge 100 including, for example, the cartridge cap 106 and the spindle 200 positioned within the cartridge cap 106. In the example shown in FIG. 3, the spindle 200 is configured to rotate relative to the cartridge cap 106. In one example, the spindle 200 rotates with the drive interface 212 including, for example, the gear 112 shown previously in FIG. 2B. Rotation of the drive interface 212 is correspondingly transmitted to the spindle 200 to thereby rotate the spindle and the spindle arms 204 relative to the dispensing port 206 and the spindle barrel 220 shown in FIG. 3.

Referring again to FIG. 3, the dispensing port 206 is shown extending from a perimeter lip 302 to an outlet 306. For instance, the dispensing port 206 includes a delivery passage 304 extending between the perimeter lip 302 and the outlet 306. As previously described herein, a shutter gasket 228 is optionally coupled with one of the shutter 226 or a lower portion of the cartridge cap 106 (and in such an example includes an orifice), for instance the spindle housing 218. As the spindle 200 is rotated the spindle arms 204 rotate around the spindle barrel 220 and deliver image-forming material delivered into the spindle barrel 220, for instance by way of the drive interface 212 and the auger 210 of the container 102. The spindle arms 204 transport the image-forming material toward the dispensing port 206. At the dispensing port 206, a sweeping face 300 of a spindle arm 204 passing across the dispensing port 206 engages with and rides along or through the perimeter lip 302 to deliver the image-forming material into the dispensing port 206 through the delivery passage 304 and to the outlet 306. In one example, the sweeping face 300 of the spindle arm 204 is sized and shaped to engage along the perimeter lip 302 in a sliding movement therealong to transport image forming material into the dispensing port 206. In another example, the spindle arms including for instance the sweeping face 300 of each of the spindle arms is sized and shaped to sweep along a portion of the perimeter lip 302, for instance an upstream portion of the perimeter lip, and thereafter pass into the perimeter lip 302. Stated another way, in one example, the spindle arms 204 have a sweeping face 300 having a width smaller than the corresponding width of the dispensing port 206 to allow the sweeping face 300 to pass into the dispensing port 206 for delivery of image-forming material into the delivery passage 304.

As previously described herein, the spindle arms 204 are, in one example, deflectable spindle arms configured to sweep along the spindle barrel 220 (e.g., in contact with the barrel or in close proximity to the barrel), for instance an interior portion of the spindle barrel 220. In one example, the spindle arms 204 include one or more of mylar, deflectable polymers, metal blades or the like configured to deflect or rotate at their bases (near the spindle core 202) relative to the trailing edges of the sweeping face 300. As further described herein, the spindle arms 204 are, in one example, formed integrally with the spindle core 202. That is to say, the spindle arms are molded or co-molded with the spindle core 202 and accordingly extend from the spindle core 202 as integral fixtures to the spindle core 202.

As further shown in FIG. 3, in another example, the cartridge 100 includes one or more vents 222 including corresponding porous membranes 224 therein. As previously described herein, the vents 222 allow for equalization of pressure between the interior of the cartridge 100 and the exterior of the cartridge. Pressure differentials therebetween are avoided (e.g., prevented or minimized) and corresponding variations of delivery of image-forming materials through the dispensing port 206 are thereby also avoided. In one example, the vents 222 are provided at a collection reservoir 308 of the spindle housing 218 and include one or more porous membranes extending across the vents 222. In the example shown in FIG. 3 and also shown in FIG. 2B, a plurality of vents 222, for instance three vents, are provided at the collection reservoir 308. A corresponding number of porous membranes 224 are also provided at the respective the vents 222. As previously described herein, the porous membranes 224 are configured to allow the ingress and egress of gases such as air there through while at the same time preventing particulate matter such as image-forming material from passing through the vents 222.

Additionally, the optional collection reservoir 308 provides a reservoir configured to receive excess image forming material received in the spindle barrel 220. The excess image forming material is instead received in the collection reservoir 308 and accordingly minimizes e.g., minimizes or prevents) the accumulation of image-forming material (caking and the like) within the spindle barrel 220 or the delivery passage 304. Instead, excess image forming material is received in the collection reservoir 308 and after building up within the collection reservoir 308 settles back toward the spindle 200 for eventual dispensing through the dispensing port 206 along with the image-forming material received from the container 102.

Figure 4:
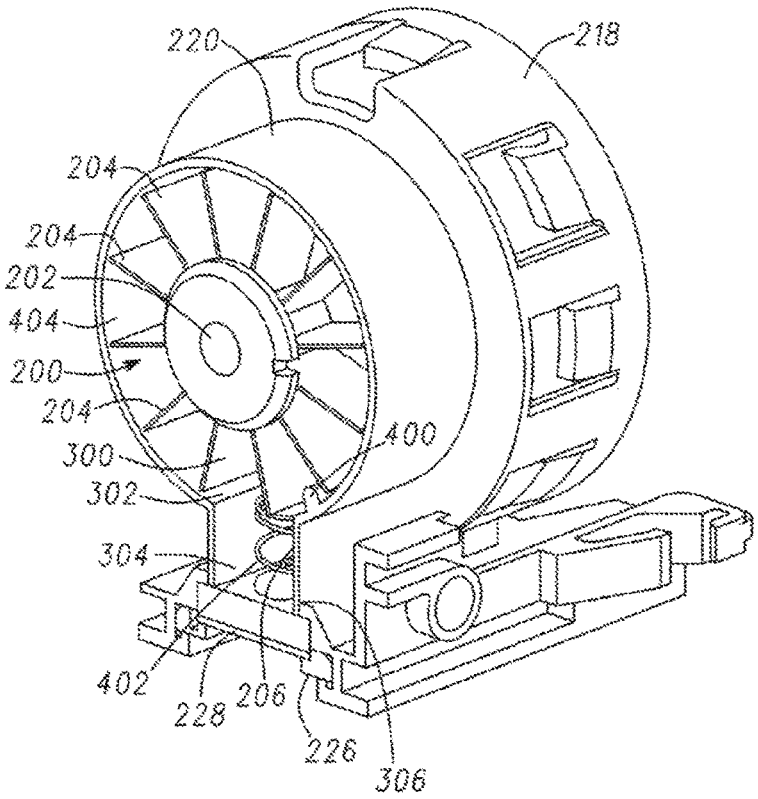
FIG. 4 is a perspective view of one example of the dispensing spindle with the spindle arms in transport and delivery configurations.

FIG. 4 shows a detailed view of a portion of the cartridge 100 including the spindle housing 218, the spindle 200 and the dispensing port 206. In operation, imaging-forming material is received at the spindle 200, for instance within the spindle barrel 220 by way of movement of the image-forming material within the cartridge 100. As previously described herein, in one example, image-forming material is moved toward the spindle 200 by a transporting feature such as the auger 210 of the container 102. Optionally, where the drive interface 212 shown in FIG. 2B is provided the auger 210 delivers the image-forming material through material passages 214 and into the spindle barrel 220.

The spindle 200 is rotated by one or more features associated with the cartridge 100. In one example, the spindle 200 is rotated by a drive shaft or other movement feature coupled with the spindle 200 (e.g., the spindle core 202) and configured for coupling with a portion of the image-forming apparatus, for instance a drive shaft interface, fitting or the like. Rotation of the spindle 200 correspondingly moves the spindle arms 204 relative to the dispensing port 206. In the example shown in FIG. 4, the spindle arms 204 are rotated in a counterclockwise fashion to thereby move the arms 204 from a transport configuration (remote or adjacent to the dispensing port 206) and through a delivery configuration (shown within or sliding along the dispensing port 206). As the arms 204 are rotated around the spindle barrel 220, the arms 204 deflect (optionally) and sweep along the spindle barrel 220 and accordingly move (e.g., push, transport or the like) image-forming material received therein toward the dispensing port 206.

After the arms 204 move through the transport configuration, they transition into the delivery configuration shown for instance with the arm 204 at the dispensing port 206. In one example, the arms 204 sweep across the dispensing port 206 and thereby deliver image forming material into the dispensing port 206 for delivery through the outlet 306 (with the shutter 226 in an open position with respect to the outlet 306). Optionally, the arm 204, such as the sweeping face 300 of the arm 204, sweeps along the entirety of the perimeter lip 302 (has a wider dimension than the width of the dispensing port 206). In another example, the sweeping face 300 sweeps along a portion of the perimeter lip 302, for instance the upstream portion, and thereafter descends into the dispensing port 206 (through the perimeter lip 302). The sweeping face 300 provides a specified amount of the image-forming material according to the shape and dimensions of the sweeping face 300 moving across the dispensing port 206. Optionally, a feature such as the cleaning ridge 400 is provided on the downstream side of the dispensing port 206. The cleaning ridge 400, in one example, engages with the sweeping face 300 to break loose or remove accumulated image-forming material on the sweeping face 300 and deliver the freed image-forming material back into the dispensing port 206.

In another example, the cartridge 100 includes a port agitator 402 provided within the dispensing port 206, for instance within the delivery passage 304. In one example, the arms 204 as described herein move along and are engaged along the barrel inner surface 404. As image-forming material is moved along the barrel inner surface 404 and into the dispensing port 206, caking, accumulation, agglomeration or the like occurs in an example between the particles of the image-forming material and (in some examples) occludes (e.g., partially or fully) the dispensing port 206. In one example, the port agitator 402 extends to an upper portion of the dispensing port 206 (through the delivery passage 304) and is engaged by the arms 204 as the arms pass across the dispensing port 206. Engagement between the arms 204 and the port agitator 402 deflects and moves the port agitator 402 in a lateral fashion and engages the port agitator 402 with the caked or accumulated image-forming material within the dispensing port 206. The engagement or striking of the image-forming material by the port agitator 402 correspondingly breaks up or loosens the image-forming material and allows for dispensing of the loosened material through the outlet 306. Optionally, the port agitator 402 extends above the perimeter lip 302 and is struck by the spindle arms 204, including spindle arms that sweep along the perimeter lip 302. In another example, the port agitator extends to the perimeter lip (e.g., is flush) or is positioned below the perimeter lip 302. In an example, the spindle arms 204 engage with the port agitator 402 by one or more of deflection into the delivery passage 304 or are dimensioned to fit into the delivery passage (e.g., have a smaller width than the delivery passage).

Figure 5:
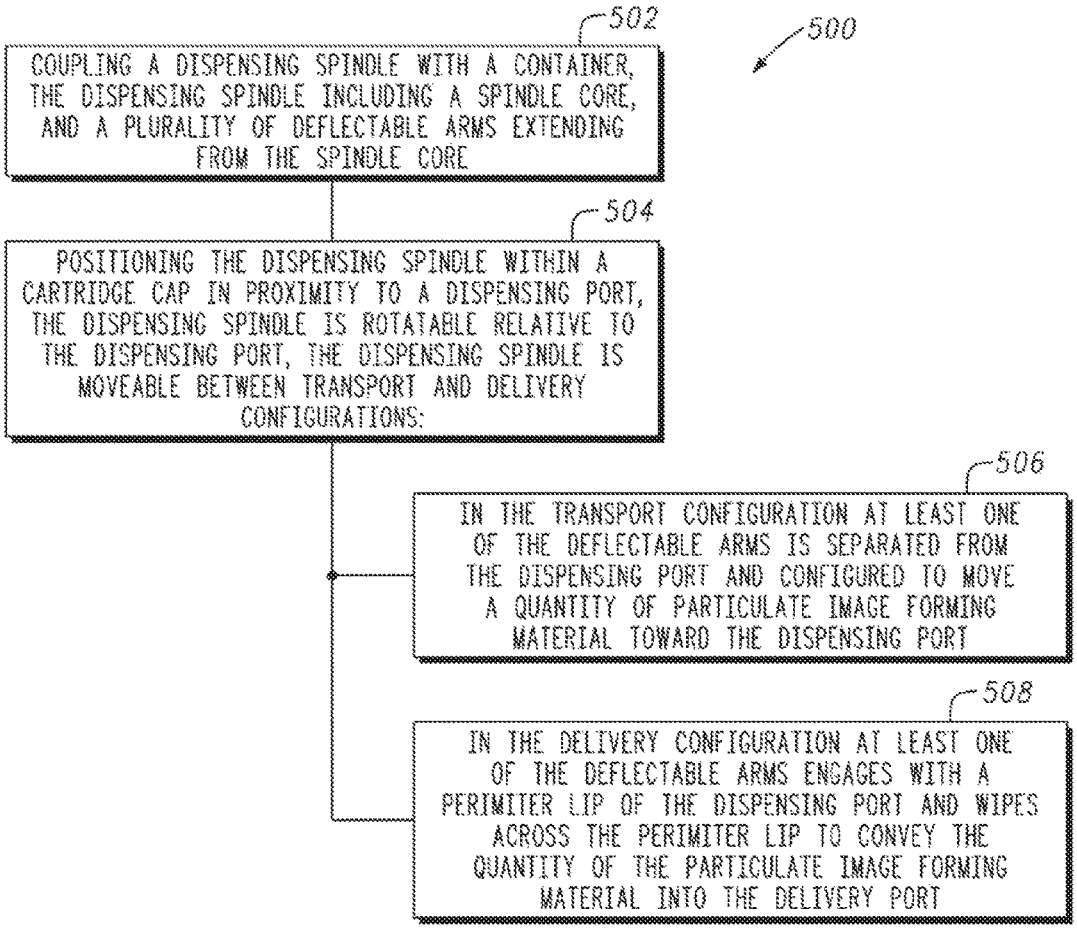
FIG. 5 is a block diagram showing one example of a method for making an image forming material cartridge.

FIG. 5 shows one example of method 500 for making a cartridge configured for use in an image-forming apparatus. In describing the method 500, reference is made to one or more components, features, functions and steps previously described herein. Where convenient, reference is made to the components, features, functions, steps and the like with reference numerals. Reference numerals provided are exemplary and are nonexclusive. For instance, components, features, functions, steps and the like described in the method 500 include, but are not limited to, the corresponding elements provided herein, other corresponding features described herein (both numbered and unnumbered) as well as their equivalents.

At 502, the method 500 includes coupling a dispensing spindle 200 with the cartridge 100 (including one or more of the container 102 and the cartridge cap 106). In one example, the dispensing spindle 200 includes a spindle core 202 and one or more deflectable arms such as spindle arms 204 extending from the spindle core 202. As previously described herein, the spindle arms 204 are, in one example, integrally formed with the spindle 200. For instance the spindle arms are co-molded or molded with the material for the spindle core 202. In another example, the spindle arms 204 are coupled with the spindle core 204. For instance, the one or more spindle arms 204 include one or more materials (optionally differing from the core 202) such as mylar, a deflectable polymer, metal blades or the like extending from the spindle core 202. As further described herein, the arms 204 of the spindle 200 in one example include, but are not limited to, blades, bristles, sweeps, fingers or the like extending from the spindle core 202.

At 504, the dispensing spindle 200 is positioned within a cartridge cap such as the cartridge cap 106 shown in the examples provided in FIGS. 2A, 2B and 3. The dispensing spindle 200 is positioned in proximity to the dispensing port 206 shown in FIG. 3. As also described herein, the dispensing spindle 200 is moveable between transport and delivery configurations. At 506, in the transport configuration at least one of the spindle arms 204 is separated from the dispensing port 206 and configured to move a quantity of particulate image-forming material toward the dispensing port 206. For instance, as shown in FIG. 4, a plurality of the arms 204 are remote or positioned away from the dispensing port 206. As the arms 204 are rotated they transport image-forming material received within the spindle barrel 220 toward the dispensing port 206. At 508, the method 500 includes at least one of the spindle arms 204 engaging with the perimeter lip 302 (see FIG. 4) of the dispensing port 206. The spindle arm 204 sweeps across the perimeter lip (the entirety of the perimeter lip or a portion thereof) to convey the quantity of the particulate image-forming material into the dispensing port 206.

Several options for the method 500 follow, in one example, coupling the dispensing spindle 200 with the container, such as the cartridge 100, includes statically coupling the dispensing spindle 200 with the container 102 of the cartridge 100. For instance, in one example, the dispensing spindle 200, as shown for instance in FIG. 29, is coupled with the container 102 and static relative to the container. Optionally, a drive interface 212 provides the interface between the dispensing spindle 200 and the container 102. In another example, the spindle 200 is configured to rotate relative to the cartridge 100 including for instance the container 102 as well as the cartridge cap 106. In such an example, a drive shaft, rotating feature or the like is coupled with the spindle 200 to rotate the spindle 200 relative to the remainder of the cartridge 100.

In another example, the method 500 includes coupling a plurality of spindle arms 204 with the spindle core 202. As previously described herein, the spindle arms 204 (where separate from the spindle core 202) are coupled with the spindle core 202 by one or more of adhesives, mechanical interference fits, fasteners such as screws, rivets or the like, clamps or other features configured to couple the spindle arms 204 to the spindle core 200.

In another example, positioning the dispensing spindle 200 within the cartridge 100, including for instance the cartridge cap 106, includes rotatably coupling the container 102 with the cartridge cap 106. Accordingly, rotation of the container 102 is used to move image-forming material toward the cartridge cap 106 and the dispensing port 206 included therein (see FIG. 3). Optionally, an interposing feature such as the drive interface 212 couples the container 102 with the cartridge cap 106 (e.g., a spindle housing 218 as shown for instance in FIG. 2B) and also provides a mechanism, such as drive gear 112, configured to receive rotation from the image-forming apparatus and transmit it to the container 102 while the cartridge cap 106 remains static. In another example, positioning the dispensing spindle 200 within the cartridge cap 106 includes positioning the dispensing spindle 200 between a collection reservoir, such as the reservoir 308 shown in FIG. 3, and the container 102. For example, as shown in FIG. 3, the dispensing spindle 200 is interposed between the collection reservoir 308 and the container 102 (shown in full detail in FIGS. 1, 2A and 2B). As previously described, the collection reservoir 308 is provided on the opposed side of the spindle 200 from the container 102 to receive overflowed image-forming material from the spindle barrel 220 to minimize (e.g., eliminate or minimize) the accumulation of caked image forming material within the spindle barrel 220.

In another example, the method 500 includes positioning a port agitator 402 (see FIG. 4) within the delivery passage 304 of the dispensing port 206. In one example, the port agitator 402 includes an elastomeric element, such as a spring, extending within the delivery passage 304. Positioning the port agitator 402 includes positioning a portion of the agitator (e.g., a spring) outside of the delivery passage 304, for instance in alignment with a portion of one or more of the arms 204 including a sweeping face 300 of the arms 204. As the arms 204 move through the delivery configuration (adjacent to the dispensing port 206) the arms 204 engage with the port agitator 402 thereby deflecting the port agitator 402 within the delivery passage 304. The deflected port agitator 402 breaks up accumulated, caked or otherwise agglomerated image-forming material collected in the delivery passage 304. In another example, the port agitator 402 is recessed within the delivery passage 304 and the arms 204 have sufficient length to extend into the dispensing port 206 and engage with the recessed port agitator 402. The port agitator is deflected by the engagement and breaks loose accumulated image-forming material within the port.

In another example, the method 500 includes coupling a gas permeable diaphragm, such as a porous membrane 224 (see FIGS. 2 and 3) with the cartridge 100. In one example, the porous membrane 224 is provided at a vent or vent hole 222 in a portion of the cartridge cap 106. As shown for instance in FIG. 3, the vent or plurality of vents 222 are provided in the spindle housing 218. Each of the vents 222, as shown in FIG. 3, includes a porous membrane 224 extending across the vents.

Various Notes & Examples

Example 1 can include subject matter, such as can include a cartridge for use with an image forming apparatus, the cartridge comprising: a container configured for storing a volume of particulate image forming material; a dispensing port in communication with the container, the dispensing port includes a perimeter lip extending around a delivery passage; and a dispensing spindle rotatable relative to at least the dispensing port, the dispensing spindle includes: a spindle core, and a plurality of arms extending from the spindle core, each of the arms includes a sweeping face configured to sweep across the perimeter lip to convey a quantity of the particulate image forming material to the dispensing port.

Example 2 can include, or can optionally be combined with the subject matter of Example 1, to optionally include wherein the dispensing spindle is coupled with the container and the dispensing spindle rotates relative to the dispensing port.

Example 3 can include, or can optionally be combined with the subject matter of one or any combination of Examples 1 or 2 to optionally include a cartridge cap coupled with the container, the cartridge cap includes the dispensing port, and the container is rotatable relative to the cartridge cap.

Example 4 can include, or can optionally be combined with the subject matter of one or any combination of Examples 1-3 to optionally include a collection reservoir in communication with the container, and the dispensing spindle is interposed between the collection reservoir and the container.

Example 5 can include, or can optionally be combined with the subject matter of one or any combination of Examples 1-4 to optionally include at least one vent extending between an interior and exterior of the container.

Example 6 can include, or can optionally be combined with the subject matter of Examples 1-5 to optionally include wherein the at least one vent includes a porous membrane.

Example 7 can include, or can optionally be combined with the subject matter of Examples 1-6 to optionally include a spindle barrel having a barrel inner surface, the spindle barrel includes the perimeter lip, and the plurality of arms are configured to sweep along the barrel inner surface and the dispensing port.

Example 8 can include, or can optionally be combined with the subject matter of Examples 1-7 to optionally include a spindle housing including the spindle barrel, the spindle housing closes the container.

Example 9 can include, or can optionally be combined with the subject matter of Examples 1-8 to optionally include wherein each of the spindle arms moves between a transport configuration and a delivery configuration: in the transport configuration the sweeping face is separated from the perimeter lip and moves the quantity of the particulate image forming material toward the dispensing port along the sweeping face, and in the delivery configuration the sweeping face sweeps across the perimeter lip to convey the quantity of the particulate image forming material to the dispensing port.

Example 10 can include, or can optionally be combined with the subject matter of Examples 1-9 to optionally include wherein each of the plurality of spindle arms are elastomeric and coupled with the spindle core.

Example 11 can include, or can optionally be combined with the subject matter of Examples 1-10 to optionally include a port agitator positioned within the delivery passage, and wherein the plurality of spindle arms are configured to operate the port agitator while sweeping across the perimeter lip and engaging the port agitator therein.

Example 12 can include, or can optionally be combined with the subject matter of Examples 1-11 to optionally include a vent in communication with the interior of the container and an exterior of the cartridge.

Example 13 can include, or can optionally be combined with the subject matter of Examples 1-12 to optionally include a cartridge for use with an image forming apparatus, the cartridge comprising: a cartridge cap including a dispensing port, the dispensing port includes a perimeter lip extending around a delivery passage; a container rotatably coupled with the cartridge cap, the container configured to store a volume of particulate image forming material, rotation of the container moves image forming material toward the cartridge cap; and a dispensing spindle within the cartridge cap and rotatable relative to the cartridge cap, the dispensing spindle includes: a spindle core within the cartridge cap, the spindle core is coupled with the container, and a plurality of spindle arms extending from the spindle core, each of the spindle arms includes a sweeping face configured to sweep across the perimeter lip to convey a quantity of the particulate image forming material to the dispensing port.

Example 14 can include, or can optionally be combined with the subject matter of Examples 1-13 to optionally include wherein the dispensing spindle is coupled with the container, and the container and the dispensing spindle rotate together relative to the dispensing port.

Example 15 can include, or can optionally be combined with the subject matter of Examples 1-14 to optionally include a collection reservoir in communication with the container, and the dispensing spindle is interposed between the collection reservoir and the container.

Example 16 can include, or can optionally be combined with the subject matter of Examples 1-15 to optionally include wherein the cartridge cap includes a spindle barrel having a barrel inner surface, the spindle barrel includes the perimeter lip, and the plurality of arms are configured to sweep along the barrel inner surface and the dispensing port.

Example 17 can include, or can optionally be combined with the subject matter of Examples 1-16 to optionally include wherein the cartridge cap includes a shell and a spindle housing having the spindle barrel, and the spindle housing is received in the shell.

Example 18 can include, or can optionally be combined with the subject matter of Examples 1-17 to optionally include a drive interface coupled with the spindle and the container, and rotation of the drive interface rotates both the spindle and the container.

Example 19 can include, or can optionally be combined with the subject matter of Examples 1-18 to optionally include wherein each of the spindle arms moves between a transport configuration and a delivery configuration: in the transport configuration the sweeping face is separated from the perimeter lip and moves the quantity of the particulate image forming material toward the dispensing port along the sweeping face, and in the delivery configuration the sweeping face sweeps across the perimeter lip to convey the quantity of the particulate image forming material to the dispensing port.

Example 20 can include, or can optionally be combined with the subject matter of Examples 1-19 to optionally include wherein each of the plurality of spindle arms are elastomeric and coupled with the spindle core.

Example 21 can include, or can optionally be combined with the subject matter of Examples 1-20 to optionally include a port agitator positioned within the delivery passage, and wherein the plurality of spindle arms are configured to operate the port agitator while sweeping across the perimeter lip and engaging the port agitator therein.

Example 22 can include, or can optionally be combined with the subject matter of Examples 1-21 to optionally include wherein the port agitator is a spring, and the plurality of spindle arms deflect the spring while sweeping across the perimeter lip.

Example 23 can include, or can optionally be combined with the subject matter of Examples 1-22 to optionally include a vent in communication with an interior of the container and an exterior of the cartridge.

Example 24 can include, or can optionally be combined with the subject matter of Examples 1-23 to optionally include a method of making a cartridge configured for use with an image forming apparatus, the method comprising: coupling a dispensing spindle with a container, the dispensing spindle including: a spindle core, and a plurality of spindle arms extending from the spindle core positioning the dispensing spindle within a cartridge cap in proximity to a dispensing port, the dispensing spindle is rotatable relative to the dispensing port, the dispensing spindle is movable between transport and delivery configurations: in the transport configuration at least one of the spindle arms is separated from the dispensing port and configured to move a quantity of particulate image forming material toward the dispensing port, and in the delivery configuration at least one of the spindle arms engages with a perimeter lip of the dispensing port and sweeps across the perimeter lip to convey the quantity of the particulate image forming material into the dispensing port.

Example 25 can include, or can optionally be combined with the subject matter of Examples 1-24 to optionally include wherein coupling the dispensing spindle with the container includes fixedly coupling the dispensing spindle with the container.

Example 26 can include, or can optionally be combined with the subject matter of Examples 1-25 to optionally include coupling the plurality of spindle arms with the spindle core.

Example 27 can include, or can optionally be combined with the subject matter of Examples 1-26 to optionally include wherein positioning the dispensing spindle within the cartridge cap includes rotatably coupling the container with the cartridge cap.

Example 28 can include, or can optionally be combined with the subject matter of Examples 1-27 to optionally include wherein positioning the dispensing spindle within the cartridge cap includes positioning the dispensing spindle between a collection reservoir within the cartridge cap and the container.

Example 29 can include, or can optionally be combined with the subject matter of Examples 1-28 to optionally include positioning a port agitator within a delivery passage of the dispensing port.

Example 30 can include, or can optionally be combined with the subject matter of Examples 1-29 to optionally include wherein the port agitator includes a spring, and positioning the port agitator includes positioning a portion of the spring outside of the delivery passage and in alignment with the plurality of deflectable arms in the delivery configuration.

Example 31 can include, or can optionally be combined with the subject matter of Examples 1-30 to optionally include coupling a gas permeable diaphragm across a vent hole in at least one of the cartridge cap or the container.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not 13," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A cartridge for use with an image forming apparatus, the cartridge comprising:

a container configured for storing a volume of particulate image forming material;

a dispensing port in communication with the container, the dispensing port includes a perimeter lip extending around a delivery passage;

a cartridge cap coupled with the container, the cartridge cap includes the dispensing port, and the container is rotatable relative to the cartridge cap; and a dispensing spindle rotatable relative to at least the dispensing port, the dispensing spindle includes:

a spindle core, and a plurality of arms extending from the spindle core, each of the arms includes a sweeping face configured to sweep across the perimeter lip to convey a quantity of the particulate image forming material to the dispensing port.

2. The cartridge of claim 1, wherein the dispensing spindle is coupled with the container and the dispensing spindle rotates relative to the dispensing port.

3. The cartridge of claim 1 comprising a collection reservoir in communication with the container, and the dispensing spindle is interposed between the collection reservoir and the container.

4. The cartridge of claim 1 comprising at least one vent extending between an interior and exterior of the container.

5. The cartridge of claim 4, wherein the at least one vent includes a porous membrane.

6. The cartridge of claim 1 comprising a spindle barrel having a barrel inner surface, the spindle barrel includes the perimeter lip, and the plurality of arms are configured to sweep along the barrel inner surface and the dispensing port.

7. The cartridge of claim 6 comprising a spindle housing including the spindle barrel, the spindle housing closes the container.

8. The cartridge of claim 1, wherein each of the spindle arms moves between a transport configuration and a delivery configuration:

in the transport configuration the sweeping face is separated from the perimeter lip and moves the quantity of the particulate image forming material toward the dispensing port along the sweeping face, and in the delivery configuration the sweeping face sweeps across the perimeter lip to convey the quantity of the particulate image forming material to the dispensing port.

9. The cartridge of claim 1, wherein each of the plurality of spindle arms are elastomeric and coupled with the spindle core.

10. The cartridge of claim 1 comprising a port agitator positioned within the delivery passage, and wherein the plurality of spindle arms are configured to operate the port agitator while sweeping across the perimeter lip and engaging the port agitator therein.

11. The cartridge of claim 1 comprising a vent in communication with the interior of the container and an exterior of the cartridge.

12. A cartridge for use with an image forming apparatus, the cartridge comprising:

a cartridge cap including a dispensing port, the dispensing port includes a perimeter lip extending around a delivery passage;

a container rotatably coupled with the cartridge cap, the container configured to store a volume of particulate image forming material, rotation of the container moves image forming material toward the cartridge cap; and a dispensing spindle within the cartridge cap and rotatable relative to the cartridge cap, the dispensing spindle includes:

a spindle core within the cartridge cap, the spindle core is coupled with the container, and a plurality of spindle arms extending from the spindle core, each of the spindle arms includes a sweeping face configured to sweep across the perimeter lip to convey a quantity of the particulate image forming material to the dispensing port.

13. The cartridge of claim 12, wherein the dispensing spindle is coupled with the container, and the container and the dispensing spindle rotate together relative to the dispensing port.

14. The cartridge of claim 12 comprising a collection reservoir in communication with the container, and the dispensing spindle is interposed between the collection reservoir and the container.

15. The cartridge of claim 12 wherein the cartridge cap includes a spindle barrel having a barrel inner surface, the spindle barrel includes the perimeter lip, and the plurality of arms are configured to sweep along the barrel inner surface and the dispensing port.

16. The cartridge of claim 15, wherein the cartridge cap includes a shell and a spindle housing having the spindle barrel, and the spindle housing is received in the shell.

17. The cartridge of claim 12 comprising a drive interface coupled with the spindle and the container, and rotation of the drive interface rotates both the spindle and the container.

18. The cartridge of claim 12, wherein each of the spindle arms moves between a transport configuration and a delivery configuration:

in the transport configuration the sweeping face is separated from the perimeter lip and moves the quantity of the particulate image forming material toward the dispensing port along the sweeping face, and in the delivery configuration the sweeping face sweeps across the perimeter lip to convey the quantity of the particulate image forming material to the dispensing port.

19. The cartridge of claim 12, wherein each of the plurality of spindle arms are elastomeric and coupled with the spindle core.

20. The cartridge of claim 12 comprising a port agitator positioned within the delivery passage, and wherein the plurality of spindle arms are configured to operate the port agitator while sweeping across the perimeter lip and engaging the port agitator therein.

21. The cartridge of claim 20, wherein the port agitator is a spring, and the plurality of spindle arms deflect the spring while sweeping across the perimeter lip.

22. The cartridge of claim 12 comprising a vent in communication with an interior of the container and an exterior of the cartridge.

23. A method of making a cartridge configured for use with an image forming apparatus, the method comprising:

coupling a dispensing spindle with a container, the dispensing spindle including:

a spindle core, and a plurality of spindle arms extending from the spindle core;

positioning the dispensing spindle within a cartridge cap in proximity to a dispensing port, the dispensing spindle is rotatable relative to the dispensing port, the dispensing spindle is movable between transport and delivery configurations:

in the transport configuration at least one of the spindle arms is separated from the dispensing port and configured to move a quantity of particulate image forming material toward the dispensing port, and in the delivery configuration at least one of the spindle arms engages with a perimeter lip of the dispensing port and sweeps across the perimeter lip to convey the quantity of the particulate image forming material into the dispensing port.

24. The method of claim 23, wherein coupling the dispensing spindle with the container includes fixedly coupling the dispensing spindle with the container.

25. The method of claim 23 comprising coupling the plurality of spindle arms with the spindle core.

26. The method of claim 23, wherein positioning the dispensing spindle within the cartridge cap includes rotatably coupling the container with the cartridge cap.

27. The method of claim 23, wherein positioning the dispensing spindle within the cartridge cap includes positioning the dispensing spindle between a collection reservoir within the cartridge cap and the container.

28. The method of claim 23 comprising positioning a port agitator within a delivery passage of the dispensing port.

29. The method of claim 28, wherein the port agitator includes a spring, and positioning the port agitator includes positioning a portion of the spring outside of the delivery passage and in alignment with the plurality of deflectable arms in the delivery configuration.

30. The method of claim 23 comprising coupling a gas permeable diaphragm across a vent hole in at least one of the cartridge cap or the container.

* * * * *